US007874027B2

(12) United States Patent
Polevoy et al.

(10) Patent No.: US 7,874,027 B2
(45) Date of Patent: Jan. 25, 2011

(54) BED FRAME SHIELDS

(75) Inventors: Richard Polevoy, Teaneck, NJ (US); Howard Scott Ryan, Skaneateles, NY (US); Paul Eric Carlson, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 229 days.

(21) Appl. No.: 11/653,793

(22) Filed: Jan. 16, 2007

(65) Prior Publication Data

US 2008/0010744 A1 Jan. 17, 2008

Related U.S. Application Data

(63) Continuation of application No. 11/005,379, filed on Dec. 6, 2004, now abandoned, which is a continuation of application No. 09/536,345, filed on Mar. 25, 2000, now Pat. No. 6,826,790.

(51) Int. Cl.
*A47C 31/00* (2006.01)

(52) U.S. Cl. ..... 5/200.1

(58) Field of Classification Search ..... 5/200.1, 5/663, 658, 201, 202; 16/18 CG; 248/345.1
See application file for complete search history.

(56) References Cited

U.S. PATENT DOCUMENTS

| | | | | |
|---|---|---|---|---|
| 2,951,252 | A | 9/1960 | Roche | 5/279 |
| 4,070,718 | A | 1/1978 | Spitz | 5/207 |
| 4,458,371 | A | 7/1984 | Whitehead | 5/200 R |
| 4,554,692 | A | 11/1985 | Whitehead | 5/411 |
| 4,710,049 | A | 12/1987 | Chang | 403/23 |
| 4,710,992 | A | 12/1987 | Falwell et al. | 5/508 |
| 5,867,853 | A | 2/1999 | Feld | 5/663 |
| 5,873,144 | A * | 2/1999 | Tupper et al. | 16/18 CG |
| 5,934,639 | A * | 8/1999 | Chiang et al. | 248/346.11 |
| 6,418,578 | B1 * | 7/2002 | Polevoy et al. | 5/200.1 |

* cited by examiner

*Primary Examiner*—Fredrick Conley
(74) *Attorney, Agent, or Firm*—Klauber & Jackson, LLC

(57) ABSTRACT

A comprehensive means of providing protection to a bed frame by covering various locations about the bed frame with plastic shields. The plastic shields are adapted to enclose the various locations about the bed frame including the ends of side rails, the junction of side rails and cross members, leg assemblies and the side rails themselves. The shields comprise a pair of housings joined together with a living hinge such that the free ends can be affixed together to surround and enclose the various locations where sharp edges are present. The use of the shields provides overall protection to all of the locations where there may be sharp edges that could harm a person striking the location and thus there is a comprehensive approach to full protection of the bed frame.

15 Claims, 18 Drawing Sheets

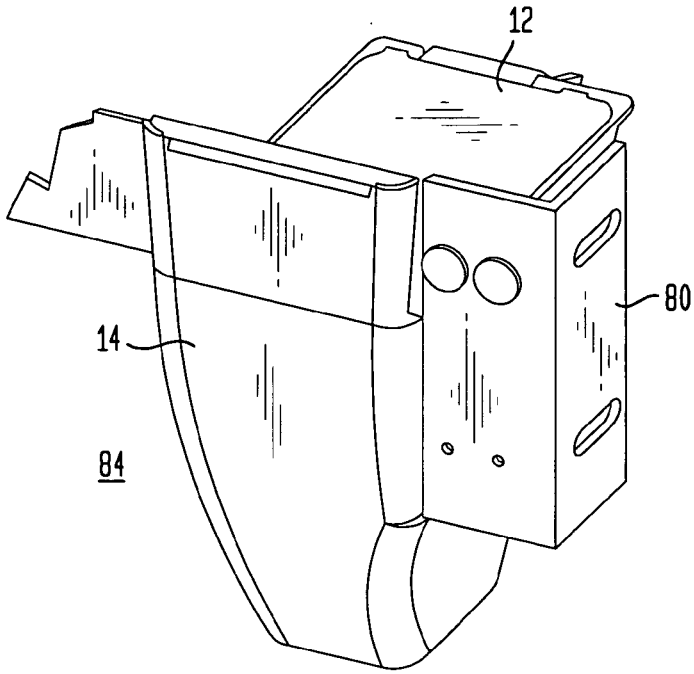
FIG. 20
FIG. 21
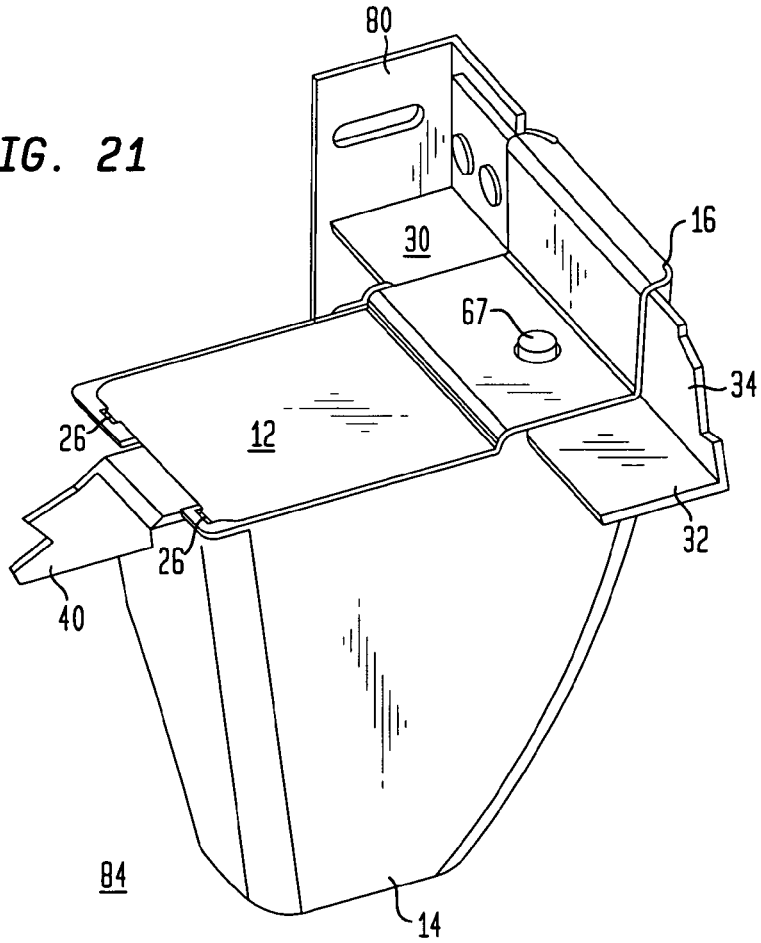

BED FRAME SHIELDS

REFERENCE TO RELATED PATENT APPLICATIONS

The present patent application is a continuation application of U.S. Ser. No. 11/005,379, filed Dec. 6, 2004 now abandoned, entitled "BED FRAME SHIELDS", which, in turn, is a continuation application of U.S. Ser. No. 09/536,345, filed Mar. 25, 2000 and entitled "BED FRAME SHIELDS", now U.S. Pat. No. 6,826,790, and priority to that patent application and patent is hereby claimed.

BACKGROUND OF THE INVENTION

The present invention relates to a bed frame construction and, more particularly, to a bed frame having protective shields that are provided at a number of locations about the bed frame to protect against the potential injury to a person inadvertently encountering an otherwise sharp edge situated at various locations about the bed frame and to the construction of the shields themselves.

There are in use today, bed frames that are used to support a box spring and mattress in order to construct a bed. In the construction of such bed frames, normally the components comprise a pair of side rails and various cross members that interconnect the side rails to make up the support for that box spring and mattress. The common side rail is constructed of an L-shaped steel member and the cross members are also of the same general configuration. Conventionally, the side rails have a vertical plane of the L-shaped angle iron extending upwardly and the horizontal plane extending inwardly to support the box spring. The cross members generally have the vertical plane extending downwardly with the horizontal plane supporting the box spring. In addition, at one of the ends of the side rails there are generally provided end brackets in order to affix a headboard to the bed frame assembly as will hereinafter be referred to as the head of the bed frame while the opposite ends of the bed frame will be referred to as the foot end of the bed frame.

As further component to the bed frame, there are also a number of leg assemblies or supports that extend downwardly from the cross members located at least at each of the four corners of the bed frame such that the bed frame is supported a finite height above the floor.

Accordingly, while the use of L-shaped steel angle iron for the side rails or the cross members results in a very sturdy construction to the bed frame, there is a problem raised in that the steel angle iron members generally have relatively sharp corners or ends and which are normally not rounded off in the manufacturing process. As such, therefore, the overall construction of the bed frame creates a number of locations about the bed frame where there are sharp edges that pose a hazard to the user or to any person walking by or in the close proximity to the bed frame, and that hazard persists even when the bed frame is supporting and therefore somewhat covered by the box spring, mattress and the bedclothes.

With a typical bed frame, therefore, those hazardous locations are generally the four corners of the bed frame where there are various edges or corners that are susceptible to being hit by a person. In particular, at the head end of the side rail, as stated, there are headboard end brackets that are available to affix a headboard to the head end of the bed frame when assembled. At the same locations there are leg assemblies that extend downwardly at the junction of the cross member at the head end of the bed frame and the side rails. Thus, at those locations at the head end of the bed frame, a person can strike the end of the side rail or hit the leg assemble and injury is possible.

Other locations are at the foot end of the bed frame where there is an extension of the L-shaped side rail that projects outwardly rearwardly beyond a junction point where a cross member is affixed to the side rails and where there is another leg assembly affixed to that cross member extending downwardly to contact the floor. Again, at the foot location of the bed frame, injury is possible to a passerby. As yet another location where there is a possibility of harm to a user, the entire length of the side rails have the vertical plane of the L-shaped angle iron extending upwardly and has a relatively sharp edge that can be encountered by a person and cause injury. Finally, the leg assemblies themselves have sharp corners or projections and thus are also locations about the bed frame where an injury to a user is potential.

There have been various attempts at alleviating the problems, however, all of such purported solutions have attacked the hazard in a more or less haphazard manner, that is, there are certain shields that have been affixed to bed frames in various locations that are specifically adapted for use at a particular location or locations. In addition, there have been other attempts to alleviate the difficulties by rearranging certain of the components to relocate the hazardous edges to a more secure location on the bed frame.

For example, in the Roche, U.S. Pat. No. 2,951,252, there is shown, an end cap that is slid on to the end of a side rail to provide some protection to that end. The use of end caps is, however, limited since the protection is localized to only the very ends of the side rails and, obviously, the concept is rather uniquely restricted to side rail ends and the side rail cap of Roche certainly cannot be used as a protective shield in any of the other hazardous locations about the bed frame. Thus, the protection is limited and the concept cannot be extended as a comprehensive solution to the overall problem of having a number of locations about the bed frame where protective shields are also needed. In addition, the use of end caps, while used today, also suffer from the problem that the end caps are not securely affixed onto the side rail ends and the end cap can easily slide off of the end of the side rail and leave the side rail ends unprotected. If unprotected, there is the aforedescribed risk of injury as well as the possibility of the bed clothes being torn by being caught on the edge of a side rail during use or damage to the box spring or mattress during installation of the bed itself.

Aside from the Roche construction, there is an inherent difficulty with the use of end caps that slip on to the end of the L-shaped side rails. With most bed frame constructions, there is a cross rail located near the ends of the side rails and where there is also located a leg assembly so that there is a leg assembly generally at the four corners of the bed frame. Thus, with a slide-on end cap, the end cap can only go a relatively short distance when it encounters the cross rail and cannot slide past that obstruction. Accordingly, while the very end of the side rail can have a end cap to provide protection, there is still the hazard of the cross rail where it connects to the side rail and, of course, the hazardous location of the leg assembly itself at that same location. With a slide on end cap, obviously, there is no way the concept of a slide on end cap can be used other than to protect the end of the side rail and certainly not the end of the cross rail and the leg assembly.

In the Feld, U.S. Pat. No. 5,867,853, there is another protective device and which is comprised of an impact absorbing material that is affixed to the L-shaped side rails to protect against an inadvertent striking of such side rail, however, again the solution is limited to the protection of the side rail and thus is not a comprehensive solution and the Feld concept does not extend readily to other locations about the bed frame where there are, as previously explained, sharp edges that can cause injury. In effect, Feld considered the top edge of the side rail to be the potentially, most likely portion of the side rail to cause injury and, thus, concentrated efforts to provide a protective cushion for that particular location and did not attempt to shield other possible locations about the bed frame that could cause injuries to a person if encountered.

With respect to protection against striking leg assemblies which, as explained, are also locations on the bed frame that can have potentially hazardous sharp surfaces, it can be noted that one solution is to move the leg assemblies inwardly toward the center of the bed and thus away from a location that could be easily struck by a person. Typical of such leg locations is shown in Spitz, U.S. Pat. No. 4,070,718 where the leg assemblies are in a more protective location, however, moving the leg assembly to an inner position of the bed frame compromises the overall strength of the bed assembly and weakens the bed construction. Accordingly, again, while Spitz may provide one solution to one particular type of potential injury causing hazard, the solution raises other problems and the solution is limited to the hazard associated with the leg assembly and is only a limited protection to but one of the potential hazardous locations about the bed frame.

As can be seen, therefore, the prior attempts to alleviate the hazardous conditions of the typical bed frame have been directed to individual solutions concentrated on specific locations about the bed frame and there is no one overall concept that can be put to use to provide a comprehensive means of protection against all of the hazardous locations about the bed frame. Instead, each of the attempted solutions is localized in its application and cannot be used as a protective shield at other, dissimilar locations. In short, prior attempts at safety devices and shields have utilized micro concepts and not macro concepts.

SUMMARY OF THE INVENTION

Now, in accordance with the present invention, there is a comprehensive bed frame and devices to attach thereto to the bed frame that protect the persons from striking sharp edges at various locations about the bed frame, and, in one embodiment, the present invention is applicable to cover all of the potential hazardous locations with a plastic shield so as to provide overall comprehensive protection for the bed frame. As will be seen, in the present disclosed embodiments, there is but a head bracket that is preferably still unprotected so as to make that bracket available for use in attaching a headboard, however, the present invention can readily be used to contain the edges of that bracket, particularly, if the user does not intend to utilize a headboard. Thus, instead of responding to the problem on a location by location basis, the present invention encompasses various locations about the bed frame where the hazardous locations are known to exist.

In the construction of the present invention, there is provided shields that can be affixed to the potentially hazardous locations about the bed frame to cover the metal surfaces to provide safety to the user. In one embodiment there is provided a leg guard that serves to provide independent protection to the leg assemble and which can be retrofitted to a bed frame by an owner without special tools or hardware. As will be seen, and as explained with respect to the deficiencies of the slip on conventional end caps, it is not possible to provide adequate protection to cover all of the offending surfaces at the corners of the bed frame with such devices as there is a limit to the distance such end caps can be slipped on to the end of the side rails. Thus, as one embodiment of the present invention there is provided an end shield that is affixed to the corner of the bed frame from the side or laterally affixed to the bed frame. Thus, the shields of the present invention can be affixed to the bed frame to fully engulf the ends of the side rails as well as the leg assembly, or part thereof. As noted, by corners and ends of the side rails, it is intended to cover the front ends of the bed frame where there are headboard end brackets as well as the foot ends of the bed frame where only the ends of the side rails project outwardly.

To be able to affix the present end shields to the bed frame corners, use is made of living hinges that are used to join two housings having free ends. The housings can rotate with respect to each other about the living hinge and but can be opened up to encircle the hazardous edges or corners and then closed about those edges to confine the hazardous conditions within the interior of the housings. The free ends are then joined together in a unique manner to affix the particular shield to the bed frame in a fairly permanent manner.

Thus, through the use of shields having living hinges, considerable more of the overall locations of the bed frame can be covered with plastic and thus, the overall bed frame continues to have all of the strength associated with the use of steel members but also has enhanced safety for the user as well as a better looking product by the plastic exterior shields.

The use of living hinges are well known for various purposes and are basically a narrowing of a plastic wall that allows that wall to flex or bend, thus taking on the characteristics of a hinge. With the present invention, however, while the use of living hinges is the preferred means of affixing the housings together so that the free ends can be manipulated to enclose the particular hazardous surfaces, it is within the scope of the present invention and the use of the housings to enclose those surfaces to use other types of hinges or to affix the housings together by means of a snap fit where the periphery of the housings can be readily affixed together to contain those surfaces.

With the present invention, various embodiments can be constructed. As indicated, there can be a shield that encloses and protect the head ends of side rails where the end bracket is located as well as the foot ends where the side rail extends outwardly. In addition, there is a shield that can cover and protect the leg assemblies adjacent the head ends and foot ends of the side rails as well as an embodiment that is elongated and can cover and protect the entire length of the side rails so that the overall bed frame has all of its exterior potentially hazardous locations encased in a plastic material. As a still furth embodiment, the head and foot end shields can act in conjunction with a leg assembly guard as an alternate means of protecting the user from injury from encountering the leg assembly. A further embodiment provides an end cap shield that covers and protects the end of a side rail while also protecting the end of a cross member affixed to a side rail at that location.

As a further feature, since the shields of the present invention are permanently affixed to the bed frame in one location or another, it is possible to add indicia on the shield, such as a web site or a phone number and that indicia will stay with the bed frame and be a substantially permanent part thereof and will lead the user back to the source of the bed frame for repeat sales.

Other features of the present bed frame shields will become more apparent in light of the following detailed description of a preferred embodiment thereof and as illustrated in the accompanying drawings.

BRIEF DESCRIPTION OF THE DRAWINGS

FIG. 20 is a perspective view of the FIG. 15 embodiment with the shield in the closed position;

FIG. 21 is a perspective view of the FIG. 15 embodiment with the shield in the closed position taken from the opposite direction as FIG. 20;

DETAILED DESCRIPTION OF THE INVENTION

Figure 1:
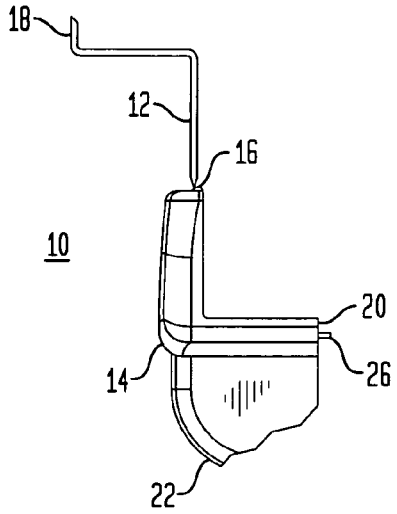
FIG. 1 is a side view of an embodiment of a shield of the present invention used at the foot end of a bed frame.
Figure 2:
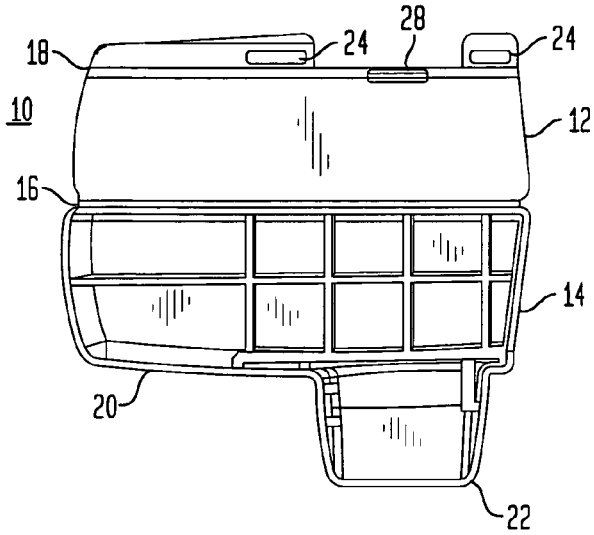
FIG. 2 is a front view of the embodiment of FIG. 1 in the open position.
Figure 3:
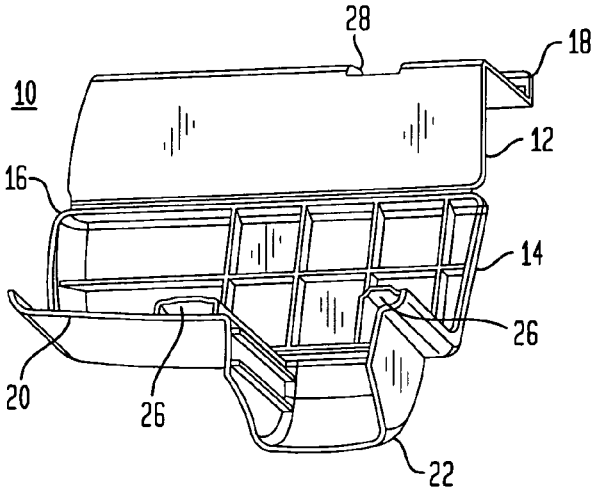
FIG. 3 is a perspective view of the FIG. 1 embodiment in the open position.

Referring now to FIGS. 1-3 there is shown a side view, a front view and a perspective view, respectively, of a top shield 10 constructed in accordance with the present invention. As shown, the top shield 10 is adapted to be used to cover the sharp edges of a bed rail and upper portion of a leg assembly as will become clear and is intended for use at the foot end of the bed frame. To distinguish the differences in orientation of the bed frame, the following embodiments are shown and described with respect to their location about a bed frame and will be referred to as the head end, that is the end of the bed frame having a end bracket for affixing a headboard to the bed frame and a foot end where the side rails simply terminate at some point extended from a leg assembly.

Although described differently to account for some differences in the preferred construction, it can be seen that there may be a universal shield that can be used in all four corners of the bed frame and thus comprise a universal shield rather than the different shields to be described with respect to the preferred embodiments herein set forth.

Accordingly, again referring to FIG. 1, there are a pair of housings comprising a first housing 12 and a second housing 14 and which are joined together by a living hinge 16 intermediate the two housings 12, 14. As such, each of the housings 12, 14, have a free end shown, respectively, as 18, 20. As can be seen, and as will become appreciated, the housings 12, 14 can have a wide variety of configurations depending upon the particular portion or edge of the bed frame that is desired to be covered and thus protected.

In the FIGS. 1-3 embodiment, the first housing 12 is in the shape of a cover while the second housing 14 is a deep hollow body having a curved lower edge 22 that is intended to cover the end of a cross member as will be seen. As is also seen in FIG. 2, there are apertures 24 formed in the free end 18 of the first housing and, in the closed position, receive tabs 26 that fit through the apertures 24 to retain the first housing 12 to the second housing 14 in its closed position about the particular portion of the bed frame. There is also a slot 28 formed in the first housing 12, the purpose of which will later become clear.

Figure 4:
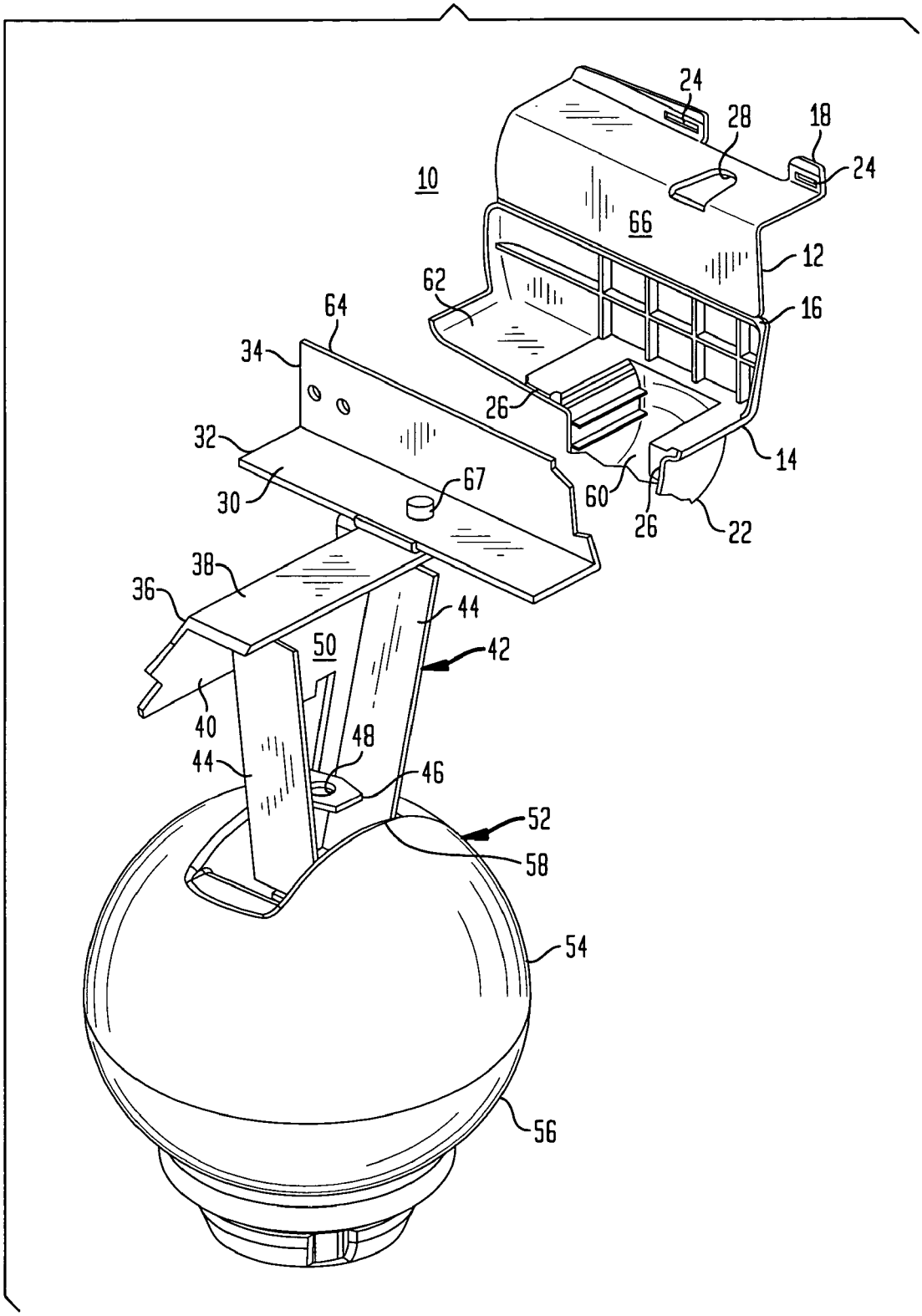
FIG. 4 is an exploded view of the shield of the FIG. 1 embodiment to be affixed to a side rail of a bed frame.

Turning now to FIG. 4, there is shown an exploded view of the top shield 10 positioned to be affixed to a side rail 30 of a bed frame. As is conventional, the side rail 30 is a L-shaped angle iron with a horizontal plane 32 and a vertical plane 34 that projects upwardly and which is adapted to contain the outer side edge of a box spring. There is also a cross member 36 that is similarly conventionally shaped as a L-shaped angle iron and which has a horizontal plane 38 adapted to underlie the box spring and a vertical plane 40 that extends downwardly therefrom.

Extending downwardly from the cross member 36 is also a leg assembly 42 and which generally comprises a pair of steel struts 44 that project downwardly and towards each other in a triangular orientation and the leg assembly 42 also includes a flange 46 having a circular opening 48 extending from a back plate 50. The circular opening 48 is adapted to receive a stem (not shown) of a caster assembly 52 to affix the caster assembly 52 to the leg assembly 42. The caster assembly can be of specially constructed design having an upper housing 54 and a lower housing 56 snapped together and a rectangular opening 58 formed in the upper housing 54 to receiver the struts 44 of the leg assembly 42.

The top shield 10 itself, as shown, has formed in the second housing 14 a curved cup like section 60 that, as will be seen, encloses the outer end of the cross member 35 as well as the upper portion of the leg assembly 42 to cover all of the sharp edges and corners of the outer end of the cross member 36 and the upper portion of the leg assembly 42. A flattened out shallow indented section 62 is formed in the second housing 14 to entrap and thus contain the end 64 of the side rail 30 since, as explained, the top shield 10 of the embodiment shown in FIGS. 1-6 is intended for use at the foot end of the bed frame where the side rail 30 terminates just beyond the location of the leg assembly 42. Thus, the top shield 10 also protects the end of the side rail 30 from causing injury to a person encountering that location of the bed frame.

Continuing on with FIG. 4, the apertures 24 can be seen that fit over the tabs 26 to secure the first housing 12 to the second housing 14 when the top shield 10 is in the closed position. It is preferred that the tabs 26 point inwardly toward the interior of the bed frame since it is likely that the exterior top shield 10 can be kicked or otherwise struck and which could push the second housing 14 inwardly. As configured, when that occurs, the housings do not become disengaged as a striking of the exterior of the housings 12, 14 will only push the tabs 26 to project further into the apertures 24 and not cause a disconnection of the affixation of the housings 12, 14 to the side rail 30. The slot 28 can also be seen to align with a slight projection that may be caused by the connection between the side rail 30 and the cross member 36 so that the lower, flat section 66 of the first housing 12 can fit alongside the horizontal plane 32 of the side rail 30.

Figure 5:
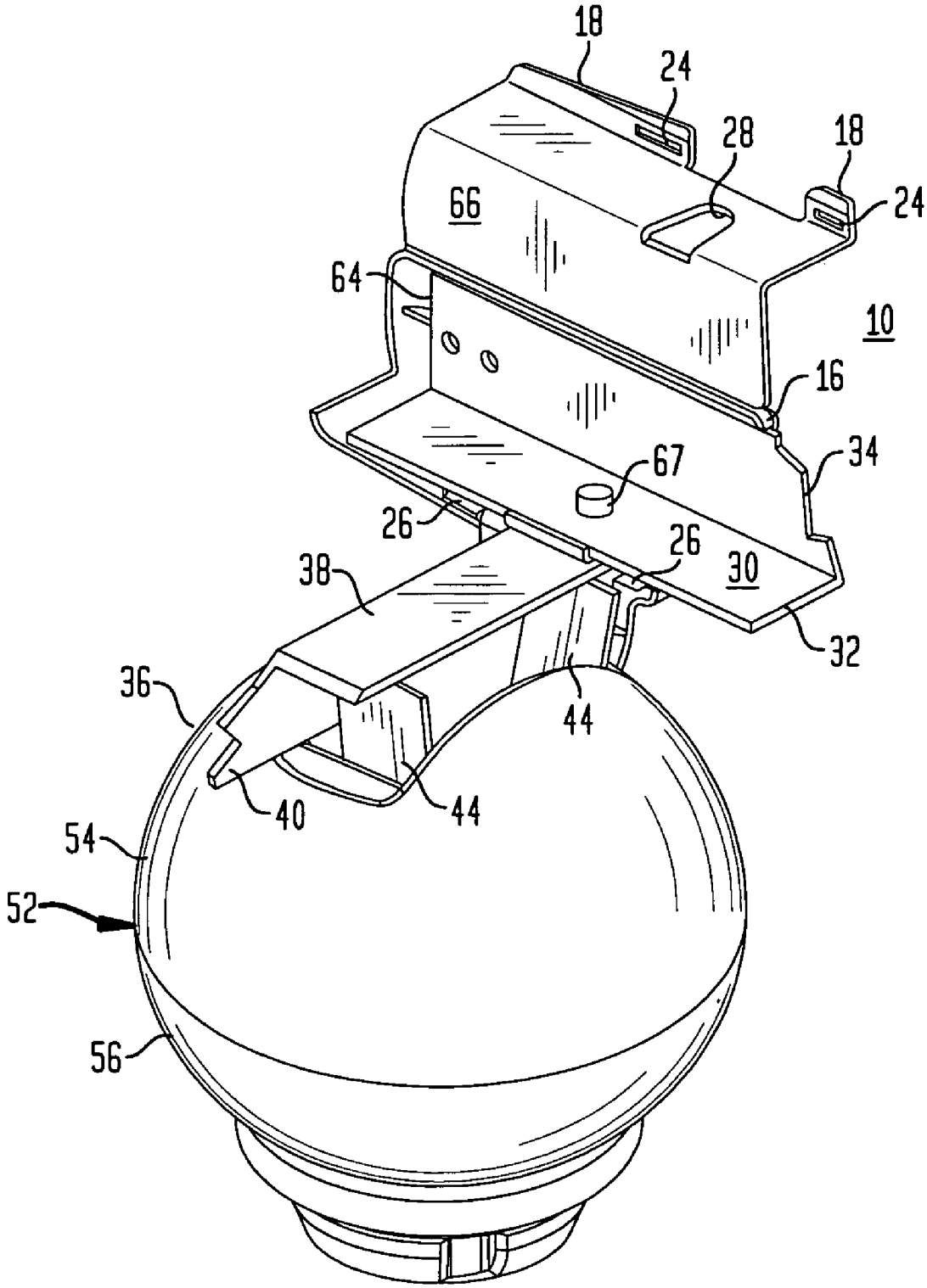
FIG. 5 is a perspective view of the FIG. 1 embodiment showing the shield affixed to a bed frame side rail with the shield in the open position.

Turning to FIG. 5, there is a perspective view of the top shield 10 in position to be affixed to the side rail 30 but where the top shield 10 is still in its open position. The caster assembly 52 is also in place and as can be seen, the vertical plane 40 of the cross member 36, in this embodiment, does not interfit into any elongated slot formed in the leg shield 10. In the FIG., however, it can readily be seen how the top shield 10 can fit over the sharp corners and edges at the foot end of the bed frame to enclose those corners and edges to protect the user from injury from encountering any of such corners and edges.

Figure 6:
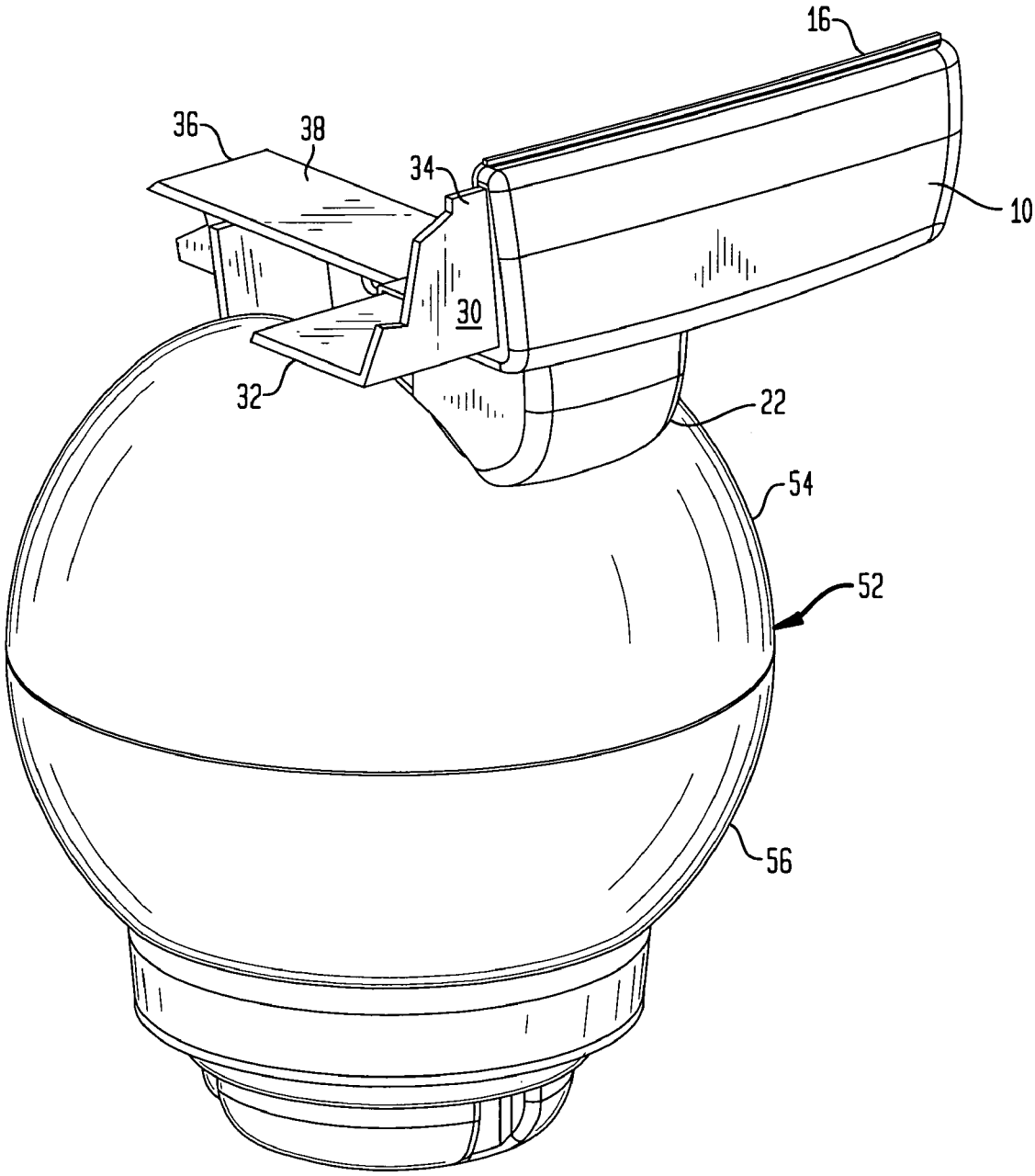
FIG. 6 is a perspective view of the FIG. 1 embodiment with the shield in the closed position.

Next, in FIG. 6, there is shown a perspective view of the top shield 10 affixed to the side rail 30 and where the top shield 10 is in its closed position, thus any sharp edges or corners have been fully enclosed and the potential danger to the user alleviated. As also seen in FIG. 6, however, the is indicia permanently placed on the exterior surface of the top shield 10 so that the user can have a relatively permanent indication of the source of the bed frame due to the fairly permanent nature of the top shield and such indicia can be a web site, phone number or other indicia to bring the source of the bed frame to the users attention.

Figure 7:
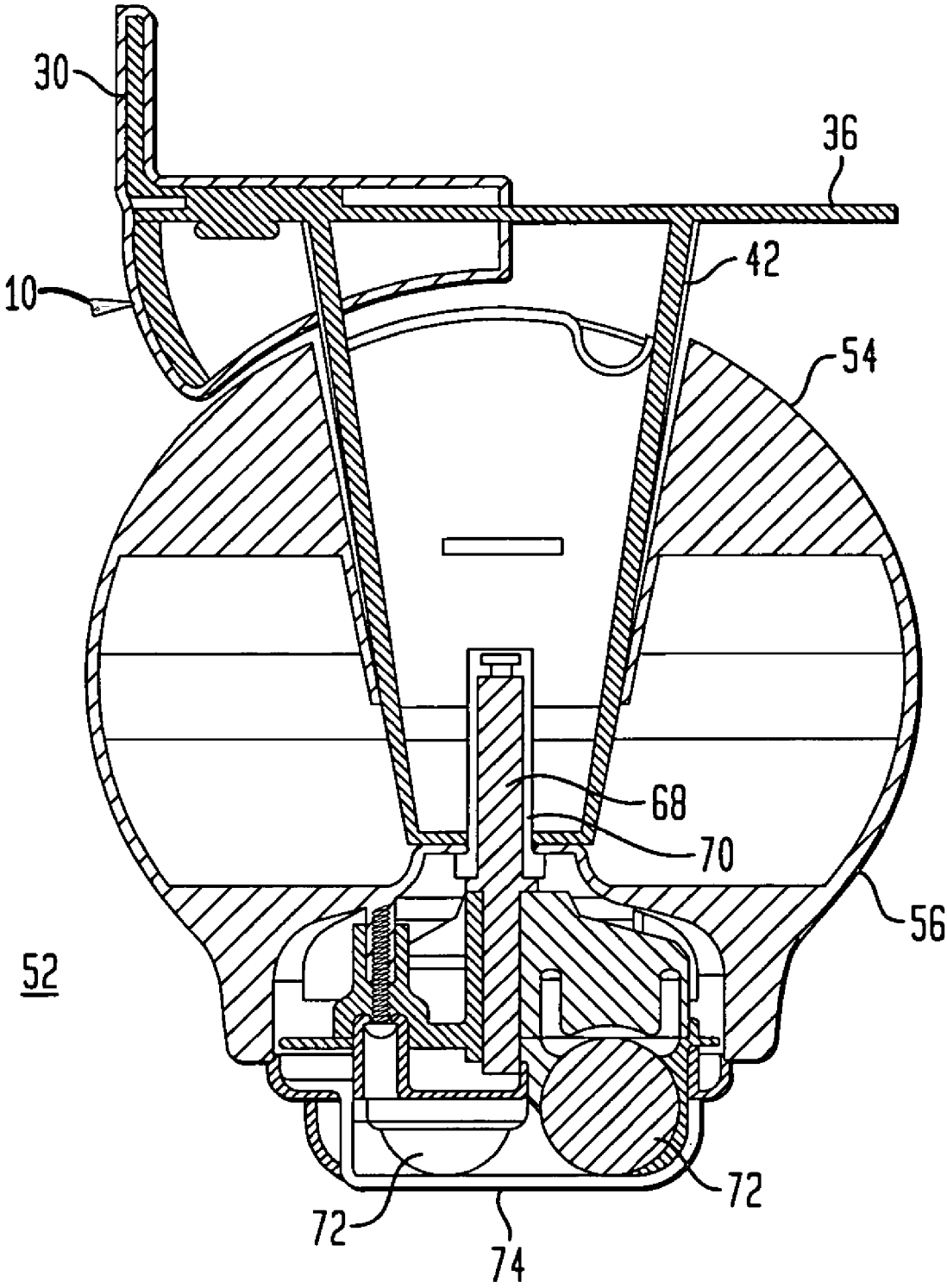
FIG. 7 is a cross sectional view of a leg shield used with the FIG. 1 embodiment.

Further in FIG. 7, the caster assembly 52 is a specially constructed caster for the preferred embodiment and comprises an upstanding stem 68 that interfits into an opening in the lower surface of the leg assembly 42 and there is a plastic bushing 70 that is interposed between the upstanding stem 68 and the leg assembly 42. The caster assembly 52 comprises an upper housing 54 and a lower housing 56 and includes a plurality of spherical rollers 72 that are mounted so as to freely rotate therein such that the caster assembly 52 is free to move in any direction as the bed frame is moved. Preferably, there are three spherical rollers. A glide 74 is removably affixed to the bottom of the caster assembly 52 to provide the function of a glide when desired by the user and the glide is adapted to be easily removed and reattached to allow the user to have the caster assembly 52 act as a roller or as a glide. The caster assembly is combined with a shield and is more fully disclosed in our co-pending patent application entitled PROTECTIVE GUARD FOR FURNITURE LEG and filed on the same day as the present application and the disclosure of such application is incorporated herein by reference.

Figure 8:
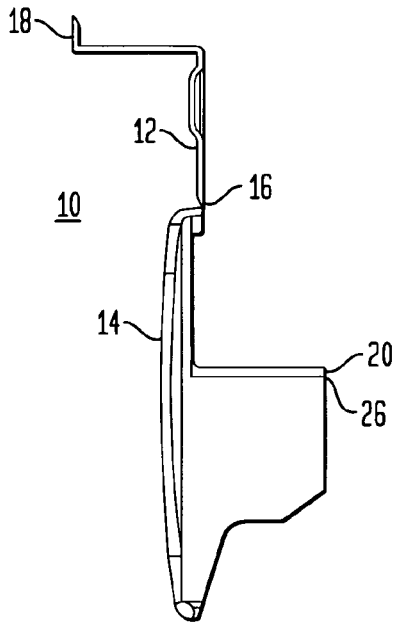
FIG. 8 is a side view of an embodiment of a shield of the present invention used at the head end of a bed frame.
Figure 9:
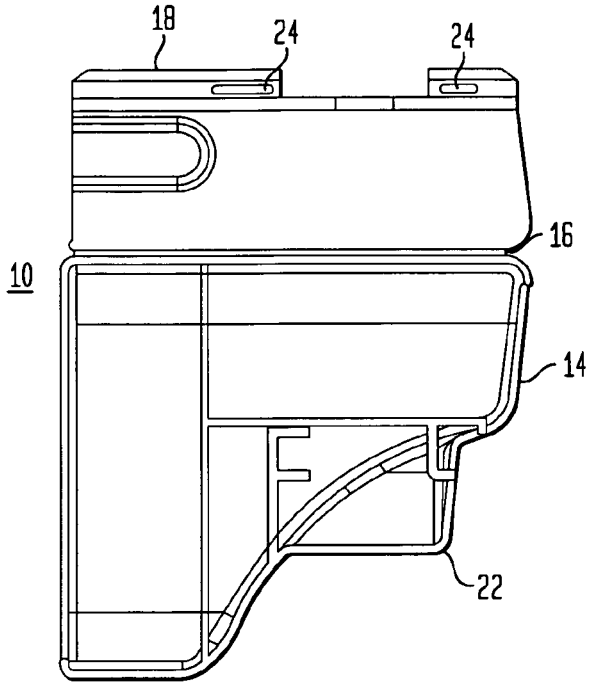
FIG. 9 is a front view of the embodiment of FIG. 8 in the open position.
Figure 10:
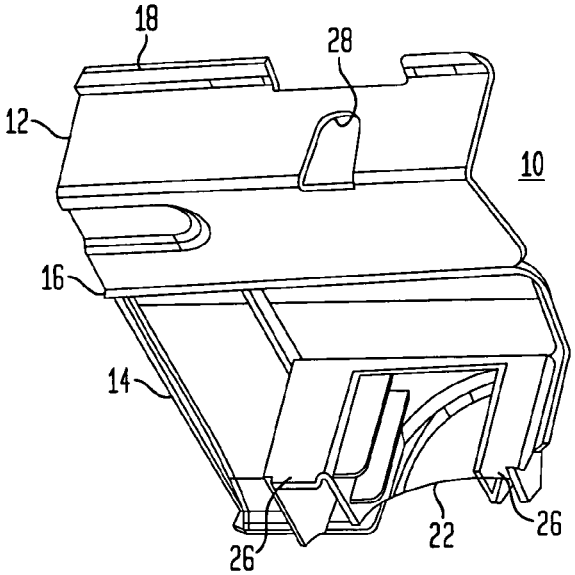
FIG. 10 is a perspective view of the FIG. 8 embodiment in the open position.
Figure 11:
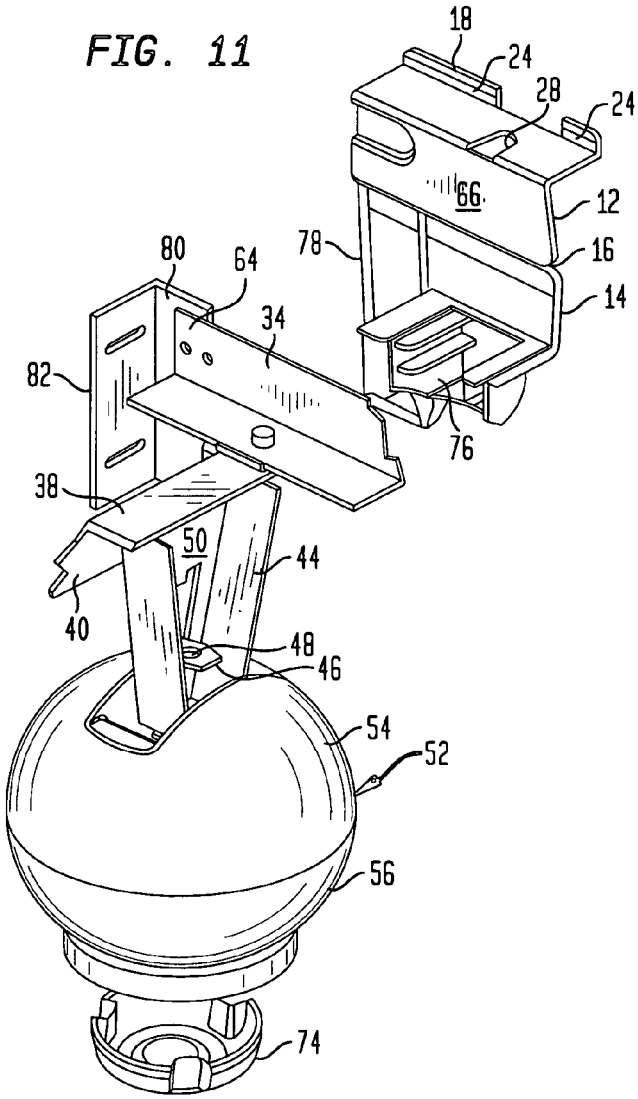
FIG. 11 is an exploded view of the shield of the FIG. 8 embodiment to be affixed to a side rail of a bed frame.

Turning now to FIGS. 8-10, there is shown a side view, a top view and a perspective view of another top shield 10 as in the prior embodiment, and where common components or features are similar to or the same as that prior embodiment, the same reference numerals will be used. In this embodiment, the top shield 10 is intended to be used at the head end of the bed frame and therefore there is an additional component involved, that of an end bracket used to affix a headboard to the bed frame when a headboard is used. Thus, again there is a first housing 12 and a second housing 14 separated by a living hinge 16 so that the two housings 12, 14 can be opened and closed with respect to each other and again there are free ends 18, 20 that can be affixed together to retain the top shield 10 to a side rail of a bed frame.

The means of affixing the free ends 18, 20 together is the same as in the prior embodiment. In this embodiment, there is a cavity section 76 to receive and cover the end of a cross member and has generally vertical edge 78 at the end thereof. In the exploded view of FIG. 1, it can be seen that the top shield 10 is to be affixed to the side rail 30 in the same manner as the prior embodiment, however, as noted, there is an end bracket 80 that must be kept clear from obstructions so as to connect the end bracket 80 to a headboard. Thus, as shown, the vertical edge 78 is positioned at the corner of the end bracket 80 and covers the end bracket 80 but not the end flat surface 82 of the end bracket 80 so as to allow that end surface 82 to be available to fit up against a headboard.

Figure 12:
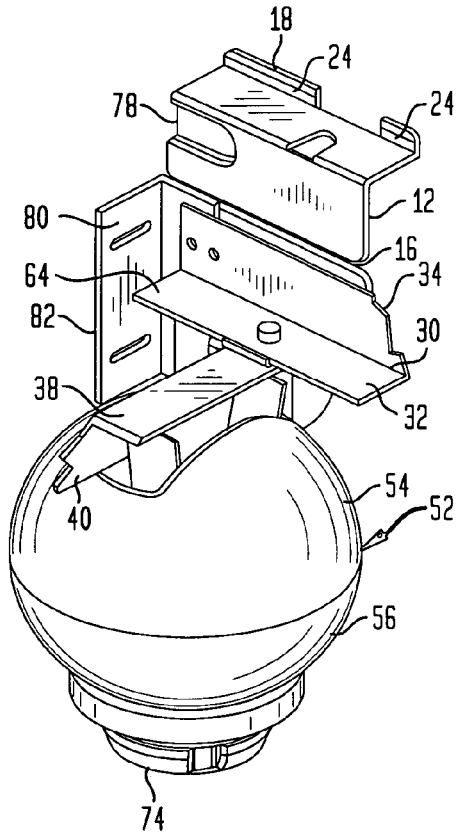
FIG. 12 is a perspective view of the FIG. 8 embodiment showing the shield affixed to a bed frame side rail with the shield in the open position.
Figure 13:
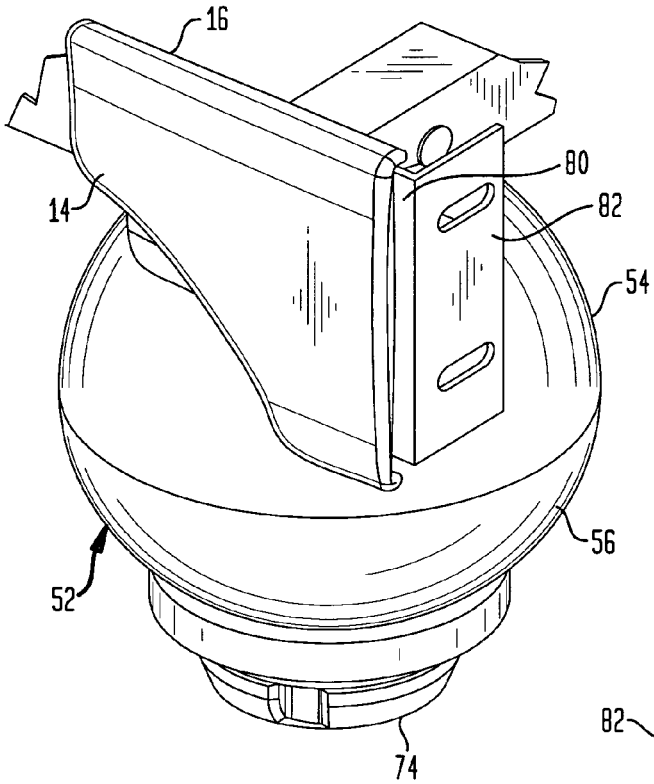
FIG. 13 is a perspective view of the FIG. 8 embodiment with the shield in the closed position.
Figure 14:
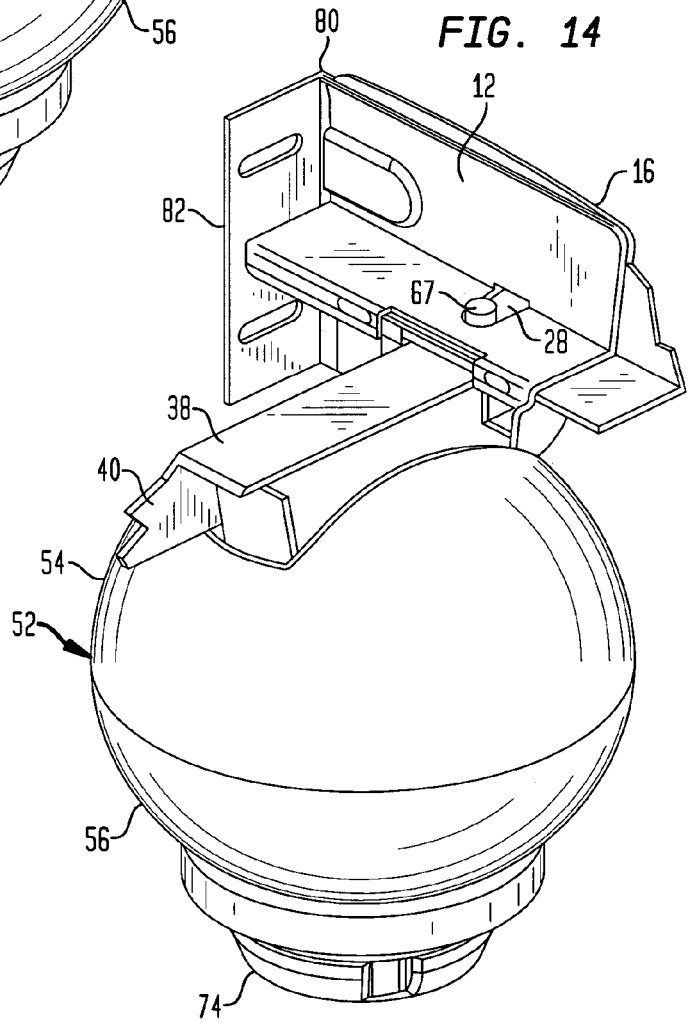
FIG. 14 is a perspective view of the FIG. 8 embodiment with the shield in the closed position taken from the opposite direction as FIG. 13.

In FIG. 12, the construction of the top shield 10 is similar to that of the prior embodiment and contains basically the same features and, in FIGS. 13 and 14, there are perspective views of the top shield 10 of this embodiment in the closed position covering the potentially sharp surfaces of the end of the cross member 36 as well as the side rail 30 with the end surface 82 of end bracket 80 remaining free to be used to affix a headboard to the bed frame.

Figure 15:
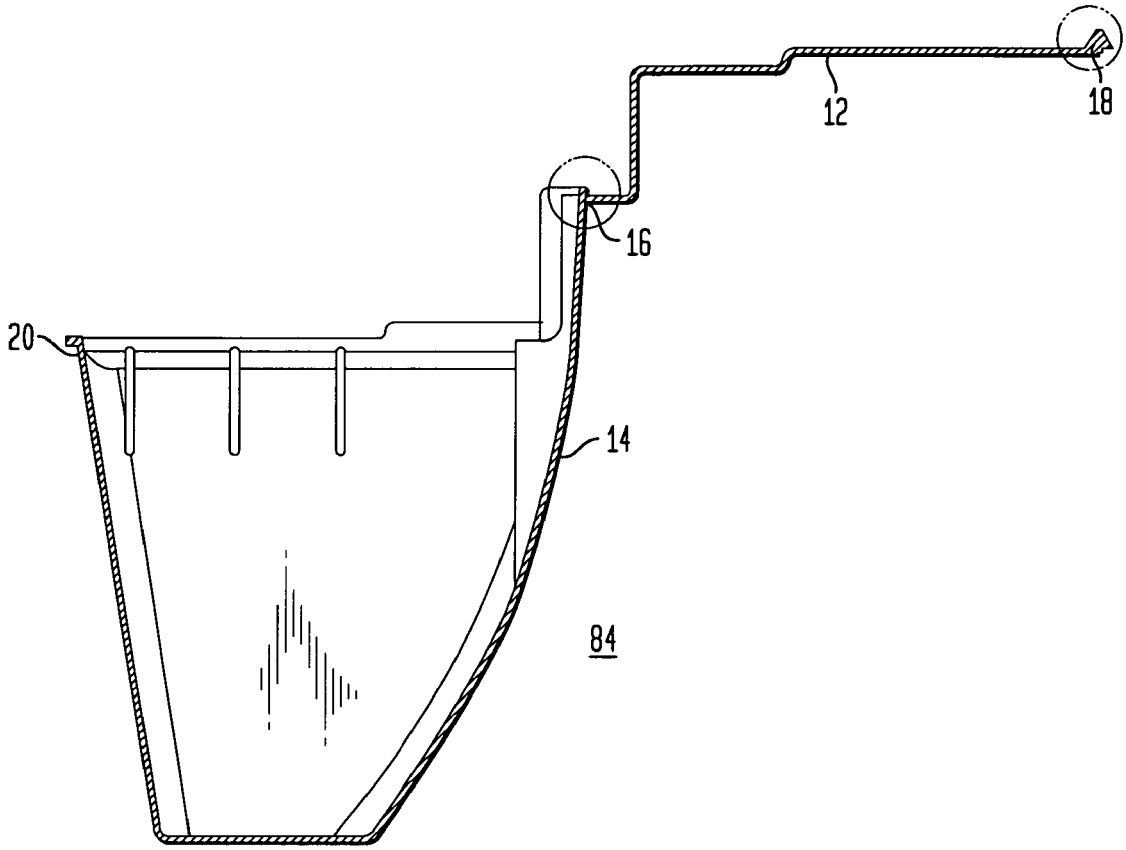
FIG. 15 is a side cross sectional view of a further embodiment of the shield of the present invention to be affixed to the head end of a bed frame.

Turning to FIG. 15, there is shown a leg shield 84 that is used as in the prior embodiment, however with the leg shield 84, the leg shield 84 is intended to cover the leg in place of the shield of those prior embodiments. According, again there is a first housing 12 and a second housing 14 joined together by a living hinge 16. It should be noted, however, that the second housing 14 is considerably deeper and can contain the leg extending downwardly from a cross member. As originally noted, the overall purpose of the present invention is to assure that there is some overall comprehensive approach to covering and thus providing protective surfaces of plastic over all of the potentially harmful metal surfaces of the bed frame. To that end, in this embodiment, it is the leg shield 84 that carries out that purpose by covering and surrounding the leg itself as well as the junction of the cross member and the side rail.

Figure 16:
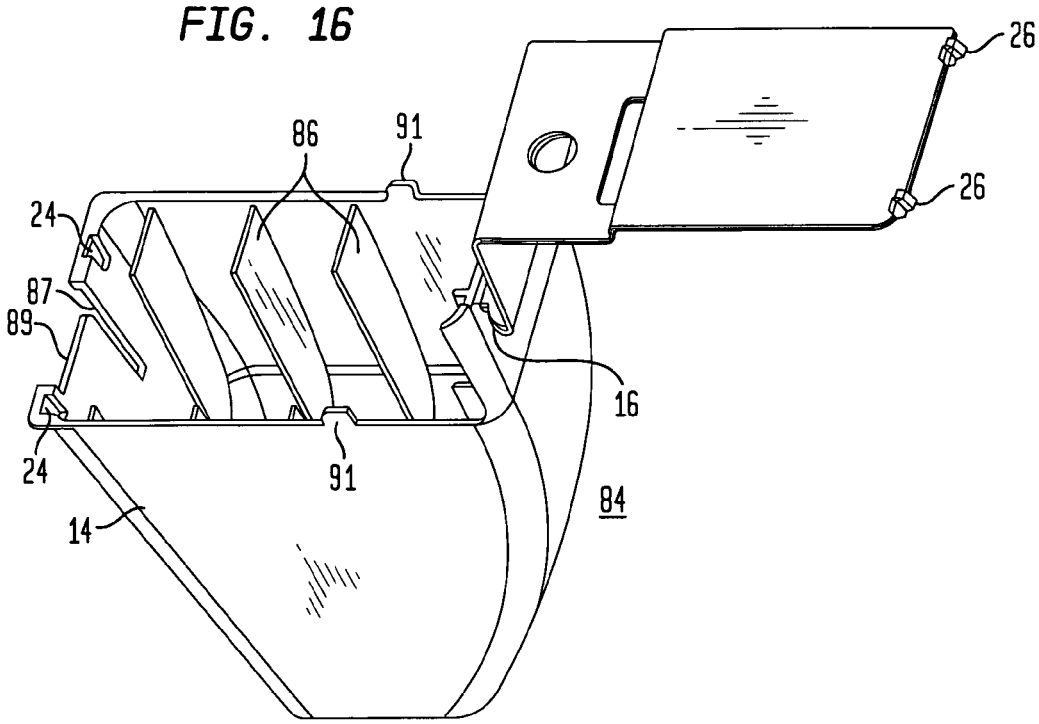
FIG. 16 is a top perspective view of the FIG. 15 embodiment with the shield in the open position.
Figure 17:
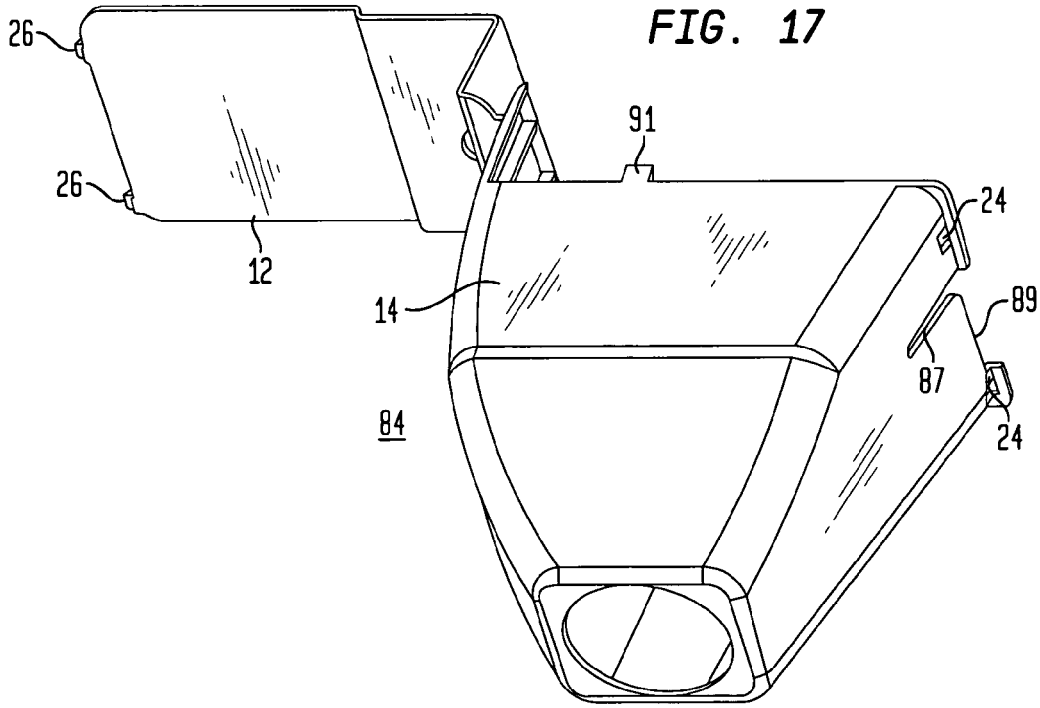
FIG. 17 is a bottom perspective view of the FIG. 15 embodiment with the shield in the open position.
Figure 19:
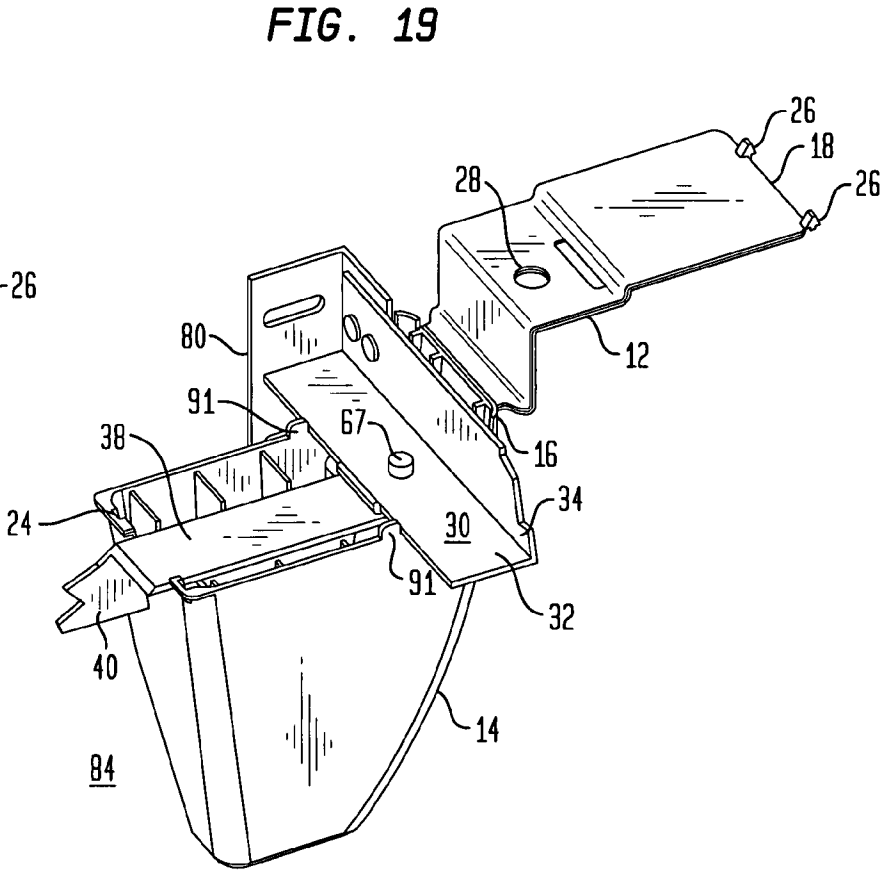
FIG. 19 is a perspective view of the FIG. 15 embodiment in position to be affixed to the side rail of a bed frame with the shield in the open position.

As such, turning to FIGS. 16 and 17, there are perspective views of the present leg shield 84 from a top view and a bottom view and, as seen, there are stiffening ribs 86 in the interior of the second housing 14 where the leg extends downwardly, however, it is also noted that the leg shield 84 is basically suspended from the side rail of the bed frame and does not carry weight or provide any support for the bed frame itself. In order to properly provide proper alignment and orientation of the leg shield 84, there is a slot 87 formed in the inwardly facing wall of the leg shield 84 that, when assembled, receives the vertical plane 40 of the cross member 36 as well as a recessed area 89 to receive the horizontal plane 38 of that cross member. In addition, there are retaining tabs 91 projecting upwardly to align with the horizontal plane 32 of the side rail 30, thus providing a positive orientation of the leg shield 84 so that the first housing 12 can be closed with the assurance that the leg shield 84 is properly positioned. That side to side orientation can more clearly be seen in FIG. 19 which is a perspective view of the leg shield 84 in position to be affixed to the side rail 30.

Figure 18:
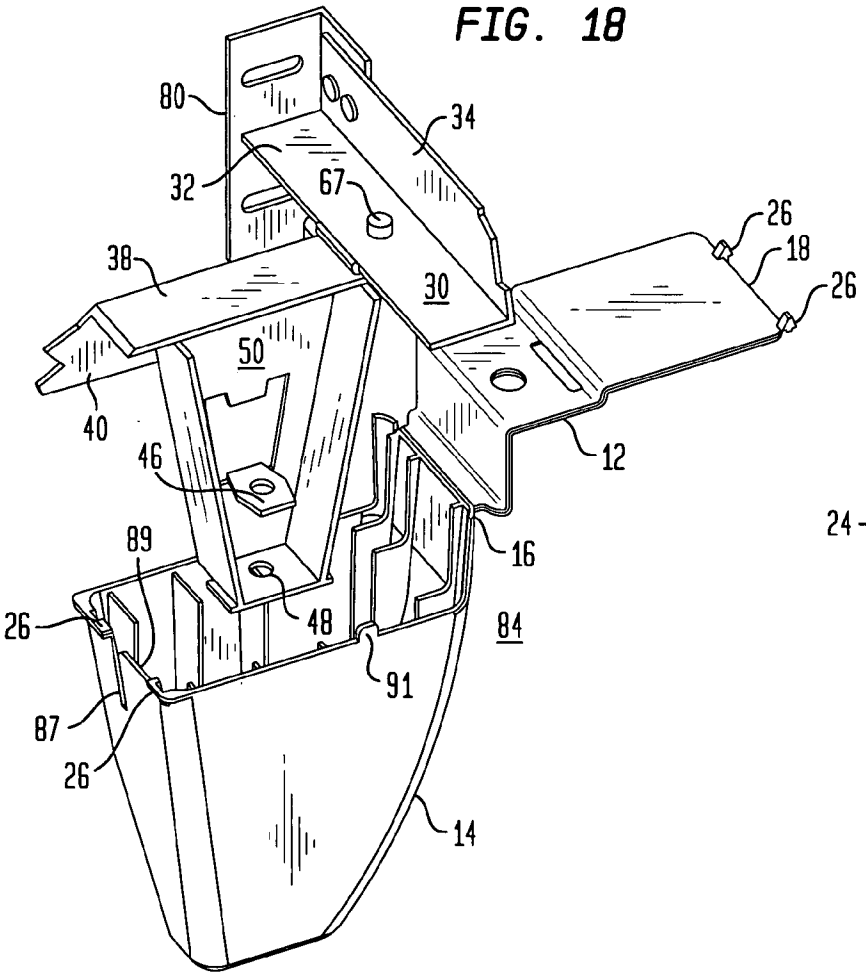
FIG. 18 is an exploded view of the shield of the FIG. 15 embodiment to be affixed to a side rail of a bed frame.

In the exploded view of FIG. 18, it can be seen how the leg shield 84 is affixed to the side rail 30 to cover that side rail, the external end of the cross member 36 as well as the leg assembly 42. In this embodiment, the leg shield 84 is adapted to be used at the head end of the bed frame and thus there is also an end bracket 80 present and which is not covered by the leg shield 84 as previously explained. As a similar feature, the tabs 26 are formed as inside snaps and therefore any pressure applied to the exterior of the leg shield will tend to better affix the first and second housings 12, 14 together and not distort the top shield 10 to cause the tabs 26 to become disengaged from the apertures 24.

Turning to FIGS. 20 and 21, there is shown perspective views of the leg shield 84 of the present embodiment affixed to the side rail 30 and, again, it can be seen that sharp edges and corners are fully covered by the plastic leg shield 84 and thus protected from causing injury to a person hitting the bed frame.

Figure 22:
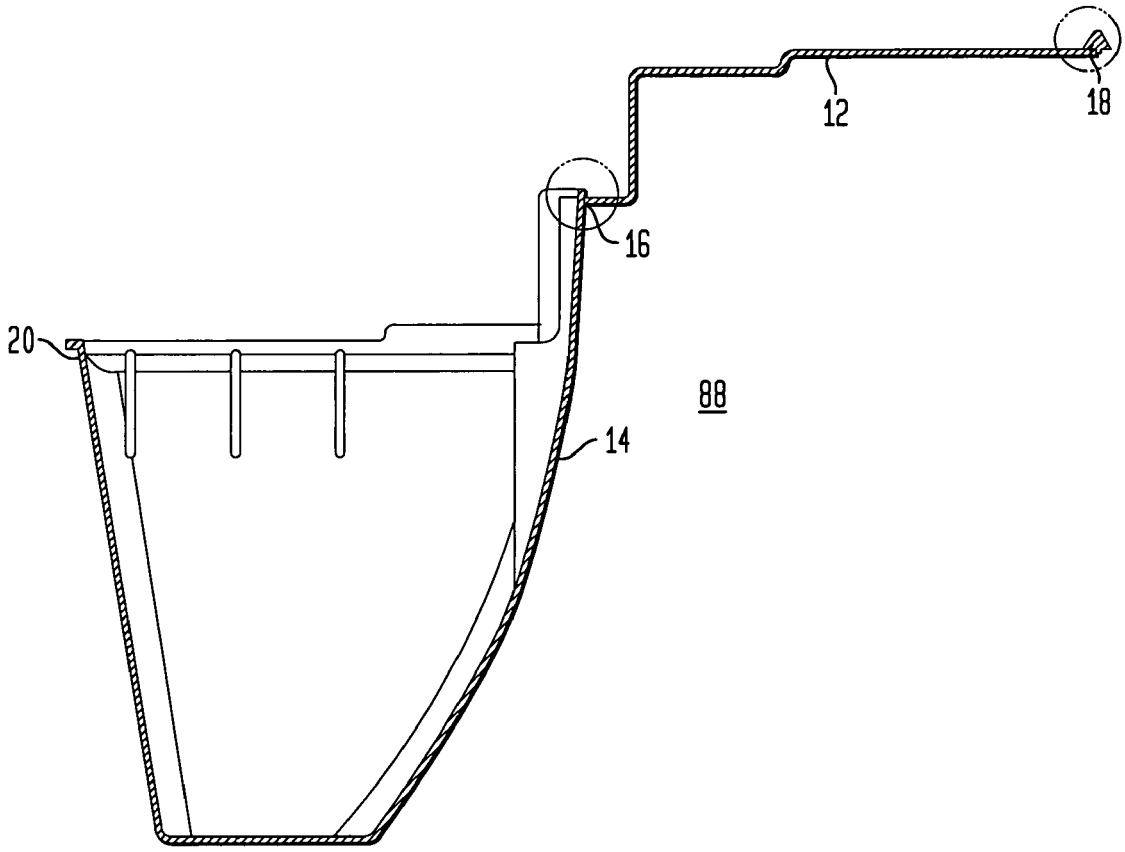
FIG. 22 is a side cross sectional view of a further embodiment of the shield of the present invention to be affixed to the foot end of a bed frame.
Figure 24:
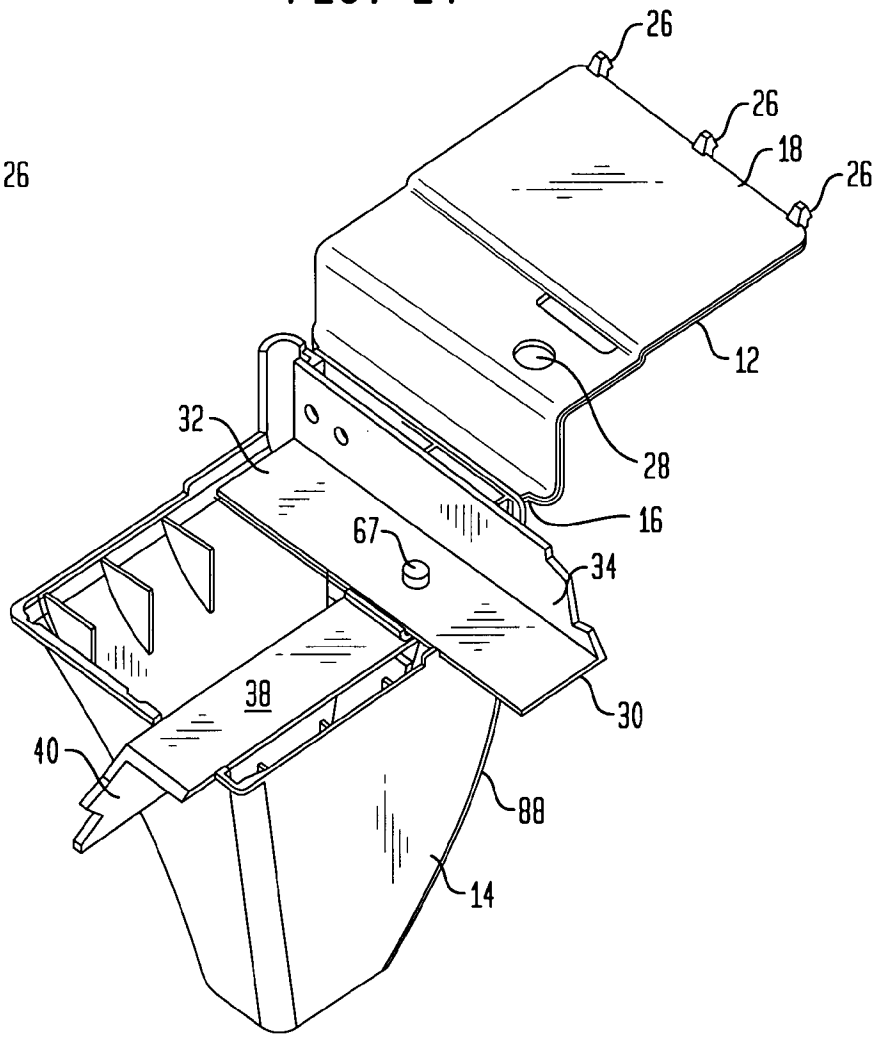
FIG. 24 is a perspective view of the FIG. 22 embodiment in position to be affixed to the side rail of a bed frame with the shield in the open position.
Figure 23:
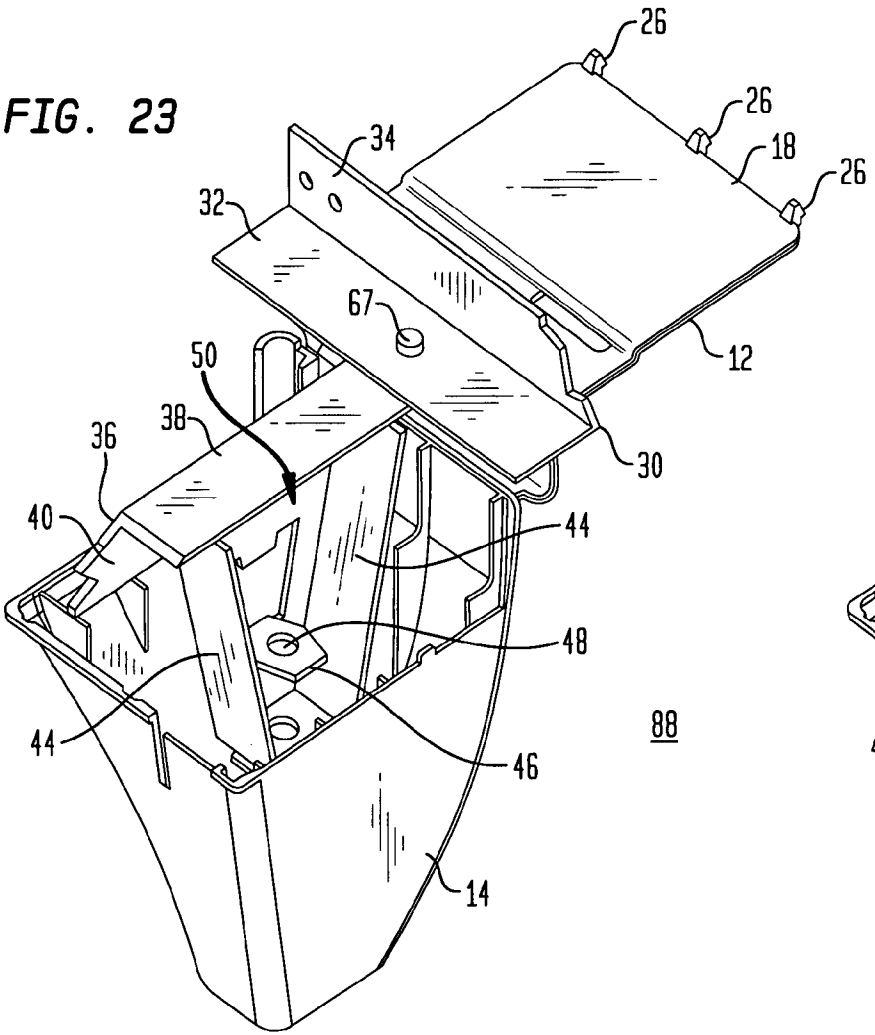
FIG. 23 is an exploded view of the shield of the FIG. 22 embodiment to be affixed to a side rail of a bed frame.

In the next embodiment, that of FIG. 22, there is shown a side view of the leg shield 88 that is adapted for use at the foot end of a bed frame. As will be seen, therefore, the leg shield 84 of this embodiment is wider in dimension than the prior leg shield since this embodiment not only covers the end of the cross member and the leg assembly but also covers all the way to the end of the side rail to cover that terminal end of the side rail. Accordingly, in the exploded view of FIG. 23, basically the same components can be seen as in the prior embodiment, however the first housing 12 may have an additional tab 26 to account for the additional width of the leg shield 84 and, as seen particularly in the perspective view of FIG. 24 with the leg shield 84 in its open position, the leg shield 84 extends out to the end of the side rail to protect against an encounter with that location, either by a person, the bedding, box spring or mattress.

Figure 25:
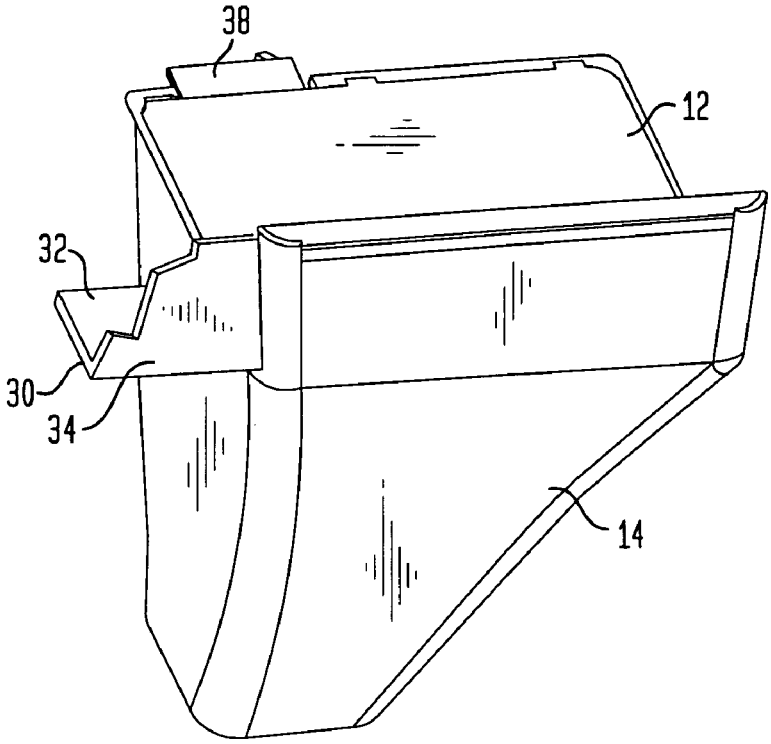
FIG. 25 is a perspective view of the FIG. 22 embodiment with the shield in the closed position.
Figure 26:
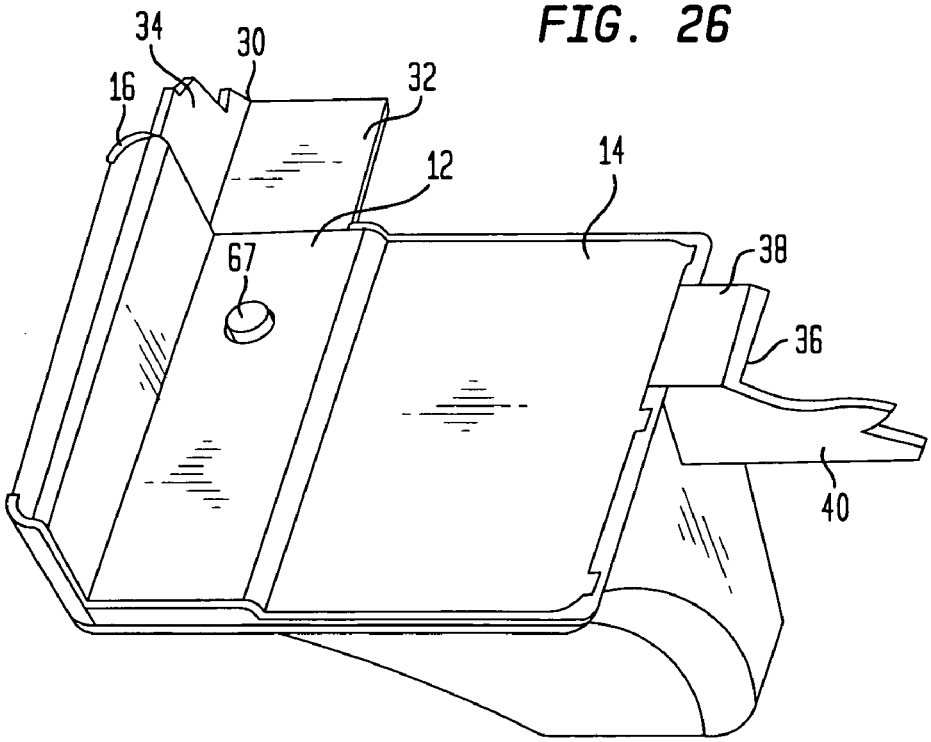
FIG. 26 is a perspective view of the FIG. 22 embodiment with the shield in the closed position taken from the opposite direction as FIG. 20.

Turning to FIGS. 25 and 26, there are shown perspective views of the leg shield 84 of this embodiment and where all of the otherwise potentially hazardous edges and corners are enclosed within the plastic material of the leg shield 84, again, in light of the intent of the present invention to contain all such sharp corners and edges of the bed frame with some protective plastic material.

Figure 27:
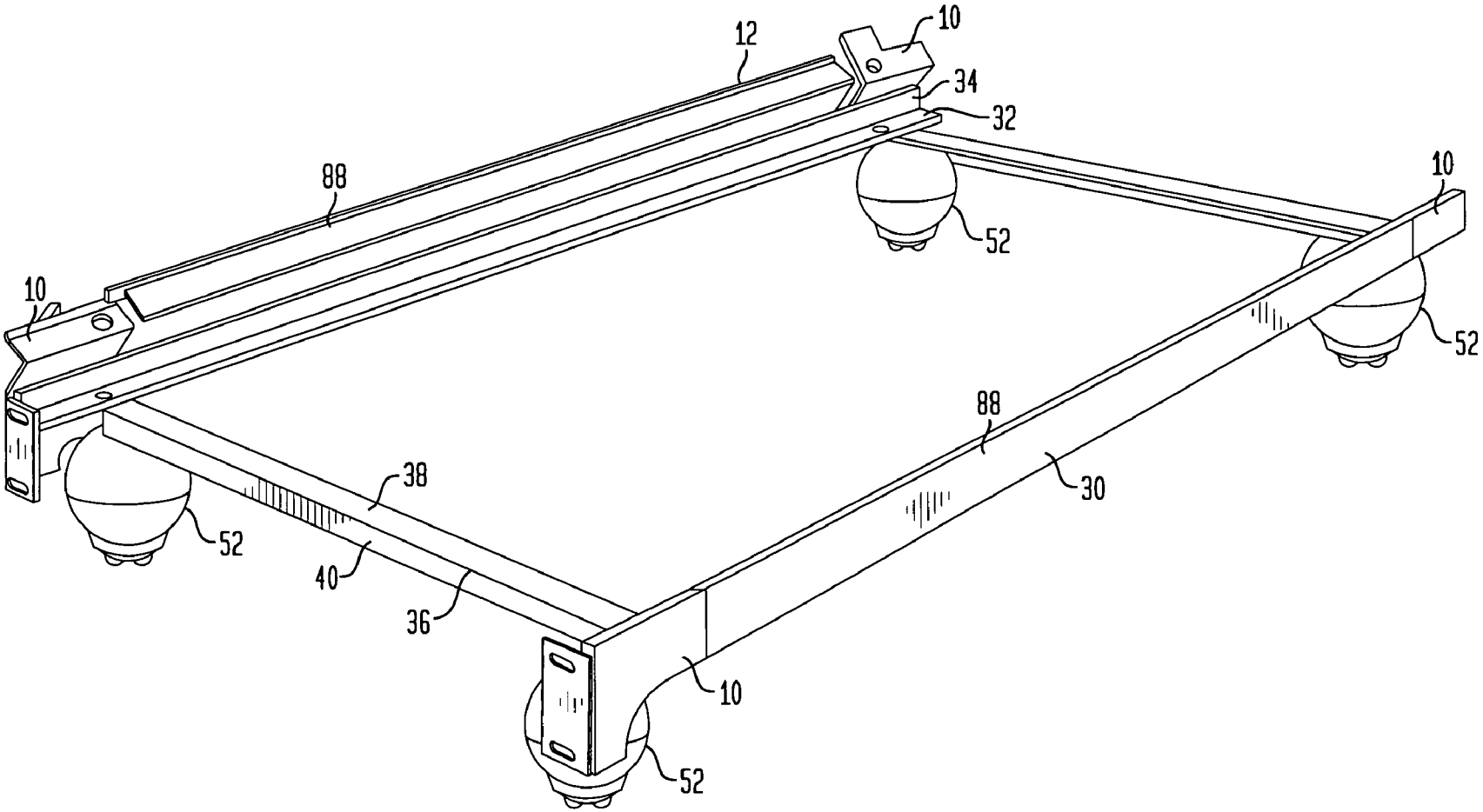
FIG. 27 is a perspective view of a further embodiment of the present invention showing a shield for substantially the entire side rail of a bed frame.

Next, in FIG. 27, there is a perspective view of an overall bed frame and showing a further side rail shield 88 constructed in accordance with the present invention. Thus, in this embodiment, there is a first housing 12 and a second housing 14 joined by a living hinge (not shown) to enable the user to cover substantially the entire length of the side rail 30. In this embodiment, there are still top shields 10 that are positioned at the foot end and the head end of the bed frame as disclosed in the prior embodiments, however, the side rail shield 88 then spans the distance between those top shields 10 to cover all of the sharp top edge of the entire vertical plane 34 of the side rail 30.

Figure 28:
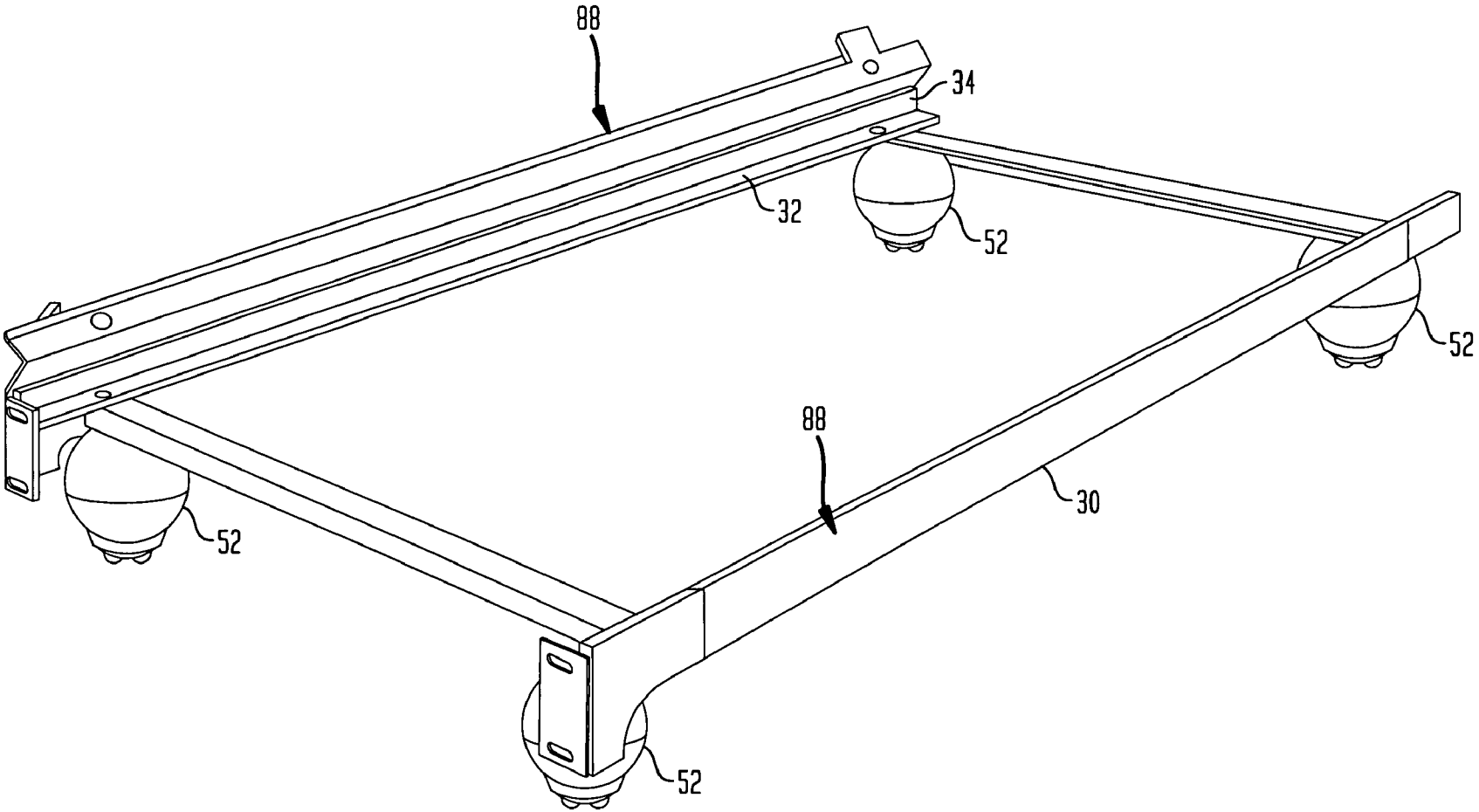
FIG. 28 is a perspective view of a still further embodiment of the present invention showing a shield for the entire side rail of a bed frame.

In the next embodiment, FIG. 28, there is a side rail shield 88 that is basically similar to the last embodiment with the exception that the side rail shield 88 does cover the entire length of the side rail 30. As can be readily seen, the means of affixing the side rail shield 88 of either embodiment can be by the use of a plurality of tabs that interfit with a plurality of apertures as disclosed with respect to other embodiments of the present invention.

Figure 29:
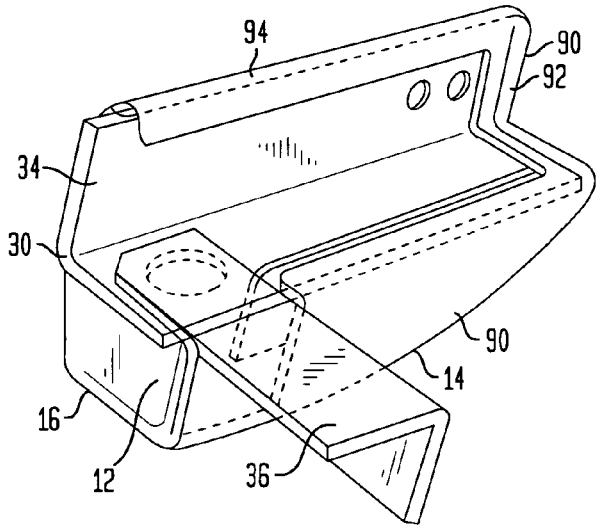
FIG. 29 is an exploded view of an end cap embodiment of the present invention.
Figure 30:
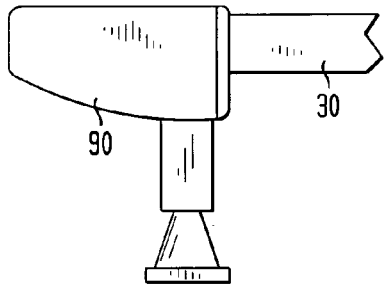
FIG. 30 is a side view of the end cap of FIG. 29 shown in position affixed to the end of a side rail.
Figure 31:
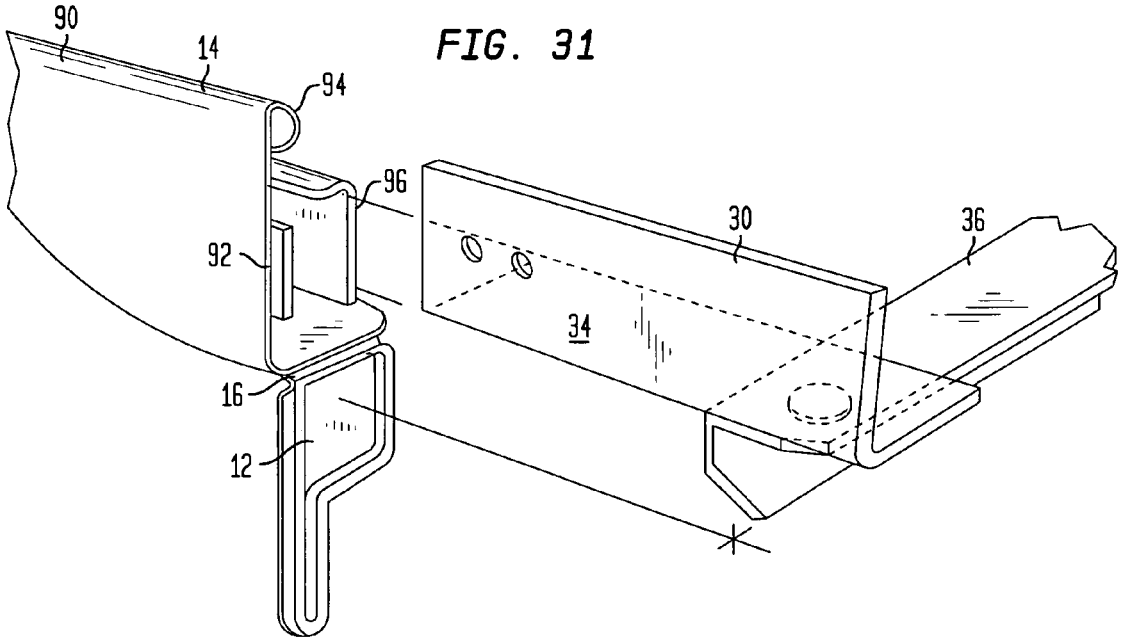
FIG. 31 is a perspective view of the end cap of FIG. 29 in position affixed to the end of a side rail.

Finally, in FIGS. 29-31, there is shown a still further embodiment of an end cap shield 90 constructed in accordance with the present invention and showing an exploded view of the end cap, shield 90 positioned to be affixed to the end of a side rail 30, a side view of the end cap shield positioned onto the end of a side rail 30 and a perspective view of the end cap shield positioned on the end of a side rail 30.

Basically, as shown, the end of side rail 30 projects outwardly from the bed frame a distance beyond a cross member 36. With the aforedescribed prior art end caps, there was a limit on the positioning of an end cap in that it could not be slid onto the end of the side rail 30 beyond a certain, limited point where it would be obstructed by the cross member 36 and could not be slid further. Thus the end of the cross member was still a hazard to passerbys and with the conventional end caps, there was no way to enclose the end of the cross member. As shown in the exploded view of FIG. 29, however, the end cap shield 90 has a high side 92 with a curled inwardly upper edge 94 that can slidingly fit over the vertical plane 34 of the side rail 30 so that the end cap shield 90 can be slid on to the L-shaped side rail 30. The opposite side 96 of the end cap shield 90 is shorter and is displaced inwardly with respect to the end of the end cap shield 90 about the distance of the width of the horizontal plane 38 of the cross member 36.

Accordingly, the end cap shield 90 can be slid onto the end of the side rail 30 to the point shown in FIG. 31 and a first housing 12 that is affixed to the second housing 14 by means of a living hinge 16 can be closed to hold the end cap shield 90 firmly in position and yet, due to the design, the high side 92 of the end cap shield is thus slid past the end of the cross member 36 to cover that cross member and protect it from doing injury to persons that could otherwise strike the end of the cross member 36. As such, when the first housing 12 is closed, with the use of the living hinge 16, the end cap shield can cover and protect the end of the side rail 30 as well as the end of the cross member 36 and provide the needed protection to the user.

While the present invention has been set forth in terms of a specific embodiment or embodiments, it will be understood that the various shields using living hinges herein disclosed may be modified or altered by those skilled in the art to other configurations. Accordingly, the invention is to be broadly construed and limited only by the scope and spirit of the claims appended hereto.

We claim:

1. A protective shield adapted to be vertically and laterally supported by a structural metal frame including at least one leg supported on a floor to enclose and contain a sharp edge or corner of the structural metal frame, said protective shield having a lower edge and comprising first and second semi-rigid, molded plastic housings, said first and second housings joined together by means of a hinge and having free ends, said first and second housings having an interlocking securing means at said free ends thereof, said housings adapted to be affixed to a structural frame in a non load-bearing relationship to retain the lower edge of the protective shield vertically raised with respect to the floor by encircling the sharp edge or corner of the metal frame to enclose and contain the sharp edge or corner by joining the interlocking securing means at said free ends of said first and second housings.

2. The protective shield as defined in claim 1 wherein said hinge is a living hinge.

3. The protective shield as defined in claim 1 wherein at least one of said first and second molded plastic housings has reinforcing ribs formed therein.

4. A protective shield as defined in claim 1 wherein said interlocking securing means comprises a tab on one of said first and second housings and an aperture on the other of said first and second housings and said tab interlocks into said aperture to join said free ends of said first and second housings together.

5. A protective shield as defined in claim 1 wherein said shield has indicia permanently placed on said shield.

6. A protective shield as defined in claim 5 wherein said indicia indicates the source of the metal frame.

7. A protective shield as defined in claim 1 wherein said interlocking securing means comprises interlocking edges on said free ends of said first and second housings adapted to be snapped together to join said free ends of said first and second housings together.

8. A structural metal frame including a leg adapted to be supported on a floor, said metal frame having sharp edges, protective shields vertically and laterally supported by the metal frame, the protective shields each having a lower edge and comprising at least first and second semi-rigid, molded plastic housings joined together by a hinge and having free ends, said first and second housings having an interlocking securing means at said free ends thereof, said protective shields adapted to be affixed to said metal frame in a non load-bearing relationship to retain each of the lower edges vertically raised with respect to the floor to enclose the sharp edges by affixing said free ends together by said interlocking means.

9. The structural metal frame as defined in claim 8 wherein said hinge is a living hinge.

10. The structural metal frame as defined in claim 8 wherein at least one of said first and second molded plastic housings has reinforcing ribs formed therein.

11. A structural metal frame as defined in claim 8 wherein said interlocking securing means comprises interlocking peripheral edges formed on said first and second housings adapted to be snapped together to join said free ends of said first and second housings together.

12. A structural metal frame as defined in claim 8 wherein one of said free ends of one of said at least first and second housings has a tab extending therefrom and said other free end of said other housing has an aperture adapted to receive said tab to affix said free ends together.

13. A structural metal frame as defined in claim 8 wherein the free ends of said first and second housings are joined together by a snap fit.

14. A method of protecting locations of a structural metal frame including a leg adapted to be supported by a floor, the structural metal frame having sharp edges, said method comprising:

providing a pair of semi-rigid, molded plastic housings having a predetermined thickness and flexibility, said molded plastic housings being joined together by means of a hinge and having free ends, positioning the housings to be vertically and laterally supported by the structural metal frame in a non load-bearing relationship so as to enclose the sharp edges of the metal frame within the molded plastic housings, closing the molded plastic housings together to enclose and contain the sharp edges, and attaching the free ends together to affix the molded plastic housings to the metal frame in a position vertically above the floor.

15. A method as defined in claim 14 wherein the step of providing a pair of molded plastic housings comprises providing a pair of molded plastic housings joined together by a living hinge.

* * * * *